US007834271B2

(12) United States Patent
Gromko et al.

(10) Patent No.: US 7,834,271 B2
(45) Date of Patent: Nov. 16, 2010

(54) CABLING HAVING SHIELDING SEPARATORS

(75) Inventors: Michael Thomas Gromko, Greensboro, NC (US); Michael Joseph Rubera, Colfax, NC (US); Richard W. Speer, Kernersville, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/431,293

(22) Filed: Apr. 28, 2009

(65) Prior Publication Data

US 2009/0272571 A1 Nov. 5, 2009

Related U.S. Application Data

(63) Continuation-in-part of application No. 12/113,032, filed on Apr. 30, 2008, now abandoned.

(51) Int. Cl.
*H01B 11/02* (2006.01)

(52) U.S. Cl. ..... 174/113 R; 174/113 C; 174/113 AS

(58) Field of Classification Search ..... 174/110 R, 174/113 R, 113 C, 120 R, 120 C, 131, 117 R, 174/117 F, 117 FF
See application file for complete search history.

(56) References Cited

U.S. PATENT DOCUMENTS

| | | | | |
|---|---|---|---|---|
| 2,538,019 | A * | 1/1951 | Lee | 156/54 |
| 3,611,200 | A * | 10/1971 | Sliepenbeek et al. | 333/143 |
| 3,848,073 | A | 11/1974 | Simons et al. | |
| 4,404,424 | A * | 9/1983 | King et al. | 174/34 |
| 4,737,598 | A * | 4/1988 | O'Connor | 174/36 |
| 4,912,283 | A * | 3/1990 | O'Connor | 174/36 |
| 5,952,615 | A | 9/1999 | Prudhon | |
| 5,956,445 | A * | 9/1999 | Deitz et al. | 385/100 |
| 6,080,935 | A * | 6/2000 | Lanoue et al. | 174/117 F |
| 6,288,340 | B1 * | 9/2001 | Arnould | 174/113 R |
| 6,310,295 | B1 * | 10/2001 | Despard | 174/113 R |
| 6,570,095 | B2 * | 5/2003 | Clark et al. | 174/113 R |
| 6,624,359 | B2 * | 9/2003 | Bahlmann et al. | 174/113 C |
| 6,787,697 | B2 | 9/2004 | Stipes et al. | |
| 6,974,913 | B2 * | 12/2005 | Bahlmann et al. | 174/113 C |
| 7,335,837 | B2 * | 2/2008 | Pfeiler et al. | 174/36 |
| 2003/0111241 | A1 * | 6/2003 | Bahlmann et al. | 174/35 R |
| 2003/0217863 | A1 * | 11/2003 | Clark et al. | 174/113 R |
| 2004/0026113 | A1 * | 2/2004 | Bahlmann et al. | 174/113 C |
| 2005/0051355 | A1 | 3/2005 | Bricker et al. | |

FOREIGN PATENT DOCUMENTS

| | | | |
|---|---|---|---|
| EP | 0 964 408 | A | 12/1999 |
| WO | WO 2004/107361 | A1 | 12/2004 |

OTHER PUBLICATIONS

PCT International Search Report; International Application No. PCT/US2009/002590; International Filing Date Apr. 29, 2009.

* cited by examiner

*Primary Examiner*—William H Mayo, III

(57) ABSTRACT

Cabling includes a jacket surrounding a core, and a separator positioned in the core. The separator has at least one shield segment defining walls separating the core into a plurality of chambers each configured to receive a plurality of twisted wire pairs. Each shield segment includes a metallic layer and a laminate layer, wherein the laminate layer defines an exposed surface of the wall of the corresponding chamber.

20 Claims, 5 Drawing Sheets

CABLING HAVING SHIELDING SEPARATORS

CROSS REFERENCE TO RELATED APPLICATIONS

This application is a continuation-in-part of and claims the benefit of U.S. patent application Ser. No. 12/113,032 titled CABLING HAVING SHIELDING SEPARATORS filed Apr. 30, 2008, the subject matter of which is herein incorporated by reference in its entirety.

BACKGROUND OF THE INVENTION

The subject matter herein relates generally to cabling, and more particularly, to shielding separators for cabling.

Communication cables typically include a number of insulated wires therein. In order to minimize the problem of interference and random noise between the wires, the wires in the cable are generally twisted in pairs. At least one type of high-speed data communications cable includes a core having a number of twisted wire pairs therein, and an insulative jacket surrounding the core. The wire pairs are arranged in a manner to optimize performance in terms of impedance, attenuation, skew, and cross talk, among other things, for high-speed data and communication networks.

Some twisted pair cables are known to include separate compartments for each twisted pair in the cable. The compartments are formed through either the configuration of the jacket or with a separator structure encased by the jacket to prevent movement of the twisted pairs and to reduce crosstalk between the twisted pairs. Typically, the separator structure is manufactured from a dielectric material and has a thickness selected to maintain separation of the wire pairs from one another. By providing thicker separator strictures, more separation is provided between the wire pairs, thus reducing the crosstalk. However, the thicker separator structures increase the overall diameter of the cable, which may increase the cost and complexity of the cable and can reduce the flexibility of the cable making it more difficult to install.

As communication cables are designed to transmit at higher speeds and frequencies, the dielectric separator structures have proven unsuccessful at reducing crosstalk to allowable levels. At least some known twisted pair cables include separators that operate as shielding members. These separators typically include metal inserts that are encased in, or otherwise inserted into, the dielectric separator structure. These conventional shielding separators are expensive to manufacture and assemble. Additionally, these conventional shielding separators remain relatively thick, thus increasing the bulk of the cable.

BRIEF DESCRIPTION OF THE INVENTION

In one embodiment, cabling is provided including a jacket surrounding a core, and a separator positioned in the core. The separator has at least one shield segment defining walls separating the core into a plurality of chambers each configured to receive a plurality of twisted wire pairs. Each shield segment includes a metallic layer and a laminate layer, wherein the laminate layer defines an exposed surface of the wall of the corresponding chamber.

In another embodiment a separator is provided for separating wire pairs within cabling. The separator includes a first shield segment including a first metallic layer and a first laminate layer, wherein the first shield segment has a first width. The separator includes a second shield segment including a second metallic layer and a second laminate layer, where the second shield segment has a second width approximately equal to the first width. The first and second shield segments are arranged such that the first metallic layer continuously engages the second metallic layer for substantially the entire first and second widths. The first laminate layer defines a first chamber within the cabling configured to receive a first of the wire pairs and the second laminate layer defines a second chamber within the cabling configured to receive a second of the wire pairs. The first and second laminate layers are exposed within the respective first and second chambers.

In a further embodiment, cabling is provided including a jacket having an inner surface defining a core that extends along a cable axis. The cabling also includes a separator positioned in the core. The separator has at least one shield segment defining at least portions of walls separating the core into a plurality of chambers each configured to receive at least one twisted wire pair. Each shield segment includes a metallic layer and a laminate layer, where the laminate layer defines an exposed surface of the wall of the corresponding chamber. The shield segments extend from proximate to the inner surface of the jacket to the cable axis such that each metallic layer engages another metallic layer at the cable axis.

DETAILED DESCRIPTION OF THE INVENTION

Figure 1:
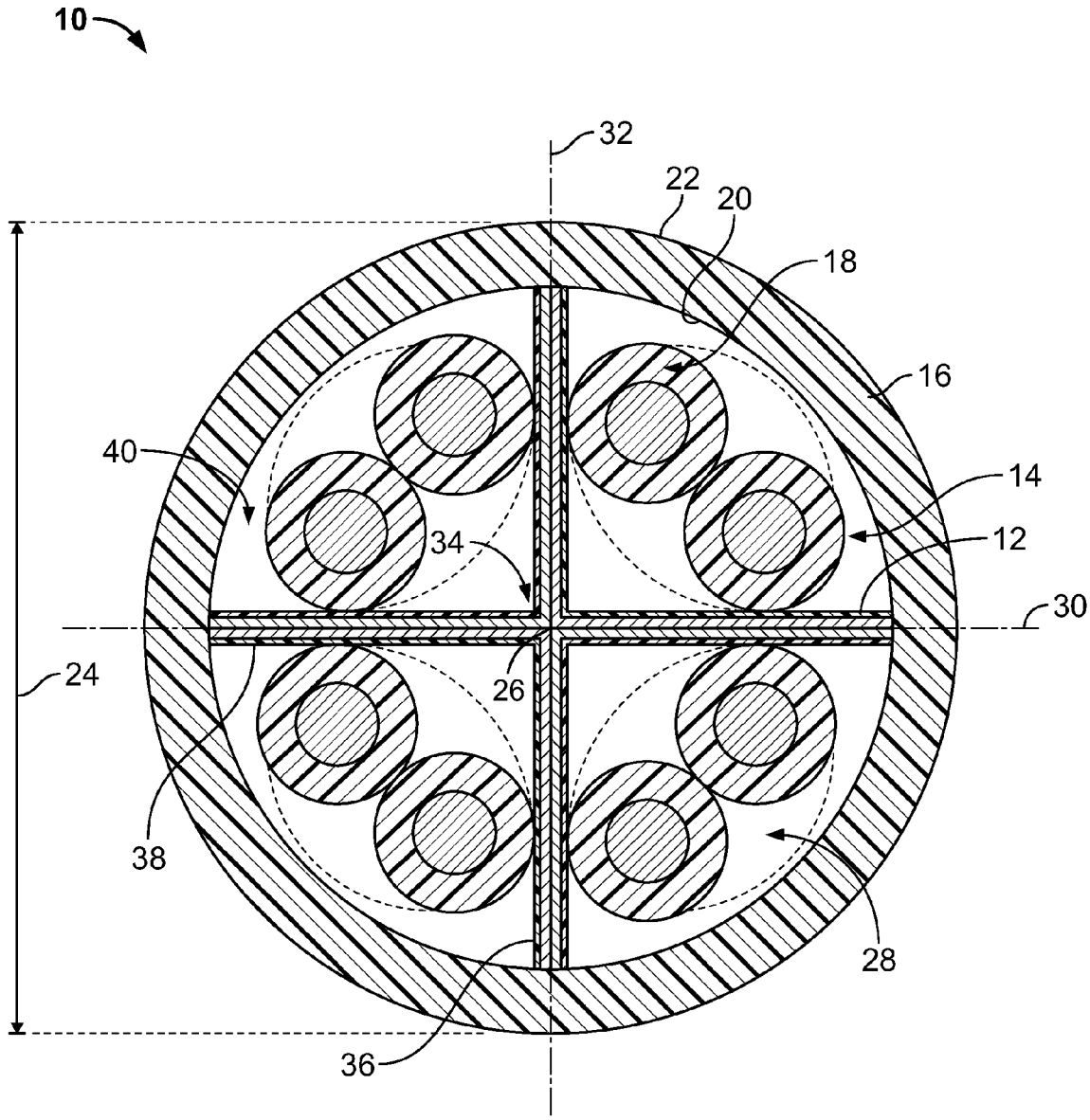
FIG. 1 is a cross-sectional view of cabling having a shielding separator in accordance with an exemplary embodiment.

FIG. 1 is a cross-sectional view of cabling 10 having a shielding separator 12 in accordance with an exemplary embodiment. In the description that follows, the cabling 10 will be described in terms of premise cabling, such as a high speed data cable. However, it is to be understood that the benefits described herein are also applicable to other types of cabling in alternative embodiments, including wires, cords or cables of any type. The following description is therefore provided for illustrative purposes only and is but one potential application of the subject matter described herein. The cabling 10 may be referred to hereinafter as a cable 10.

The cable 10 includes a core 14 and a jacket 16 surrounding the core 14. The separator 12 is positioned within the core 14. A plurality of insulated wires 18 are also provided within the core 14. The wires 18 are arranged in twisted pairs and the separator 12 separates at least some of the insulated pairs from other insulated pairs. In the illustrated embodiment, eight wires 18 are provided and arranged in four pairs, however greater or fewer numbers of wires may be employed in greater or fewer numbers of pairs in alternative embodiments. In other embodiments the wires 18 may be uninsulated. The wires 18 may be arranged as individual wires rather than twisted pairs. As described in further detail below, the separator 12 provides inter-cable shielding between the twisted pairs of the cable 10. As such, the separator 12 shields the pairs from one another. Other components, such as a cable shield (not shown) provides intra-cable shielding that shields the pairs from interference external to the cable 10, such as from nearby cables or other electronic components, rather than using the separator 12 to extend around a substantial portion of the wires 18 to provide shielding around the outward facing portions of the wires 18. Wrapping the separator around the wires 18 would require a wider separator 12 at greater cost for the separator and thus the cable 10.

The jacket 16 surrounds the core 14 and is fabricated from an insulative, non-conductive material. Optionally, the cable 10 may include a cable shield (not shown) that may be provided along an inner or outer surface of the jacket 16. The cable shield shields the pairs from interference external to the cable, such as from other cables or from electronic components near the cable 10. In the illustrated embodiment, the jacket 16 includes a smooth inner surface 20 and a smooth outer surface 22. In alternative embodiments, the inner and/or outer surface 20, 22 may not be smooth. The jacket 16 defines a diameter 24 of the cable 10. The cable 10 and the jacket 16 extend along a cable axis 26 extending along the length of the cable 10.

The core 14 is generally hollow and surrounds the cable axis 26. The core 14 is configured to receive the separator 12 and the wires 18. The separator 12 and the wires 18 may be loaded into the core 14 during a cabling operation. For example, the separator 12 and the wires 18 may be pulled into the core 14 during the cabling operation. Optionally, the separator 12 and the wires 18 are pulled into the core 14 simultaneously. Alternatively, the separator 12 may be loaded into the core 14 either before or after the wires 18 are loaded into the core 14. In an exemplary embodiment, the separator 12 generally maintains its shape when assembled and pulled into the core. For example, in the illustrated embodiment, the separator 12 has a cruciform shape. The separator 12 maintains a cruciform shape along the length of the cable 10. Optionally, during the cabling operation, the pairs may be twisted around one another such that the pairs are helically arranged along the cable axis 26. The separator 12 is likewise helically wound through the cable 10, but generally maintains the cruciform shape at any cross-section of the cable 10.

In an exemplary embodiment, the cruciform shape of the separator 12 divides the core 14 into four quadrants 28. The quadrants 28 mayor may not be identically sized and shaped. The quadrants 28 may define approximately a quarter of the area of the cross-section of the core 14, however, some quadrants may be slightly larger than other quadrants. The quadrants 28 are defined by a primary lateral axis 30 and a secondary lateral axis 32. The primary and secondary lateral axes 30, 32 may be substantially linear or planar and perpendicular to one another, however, the axes 30, 32 may be curved along portions thereof, such as to accommodate the twisting of the wires 18. In an exemplary embodiment, the separator 12 generally extends along the lateral axes 30, 32. For example, the separator 12 defines a hub 34 generally positioned at the cable axis 26 and a plurality of spokes or legs 36 that extend radially outward along the lateral axes 30, 32 from the hub 34. Each of the legs 36 meet and touch at the center of the hub 34 generally along the cable axis 26. The separator 12 generally extends along the cable axis 26. In an exemplary embodiment, the legs 36 extend from the hub 34 to the jacket 16. The legs 36 define walls 38 that separate the core 14 into a plurality of chambers 40 that are configured to receive the wire pairs. In the illustrated embodiment, the walls 38 define four chambers 40 that are each positioned in a different quadrant 28.

Figure 2:
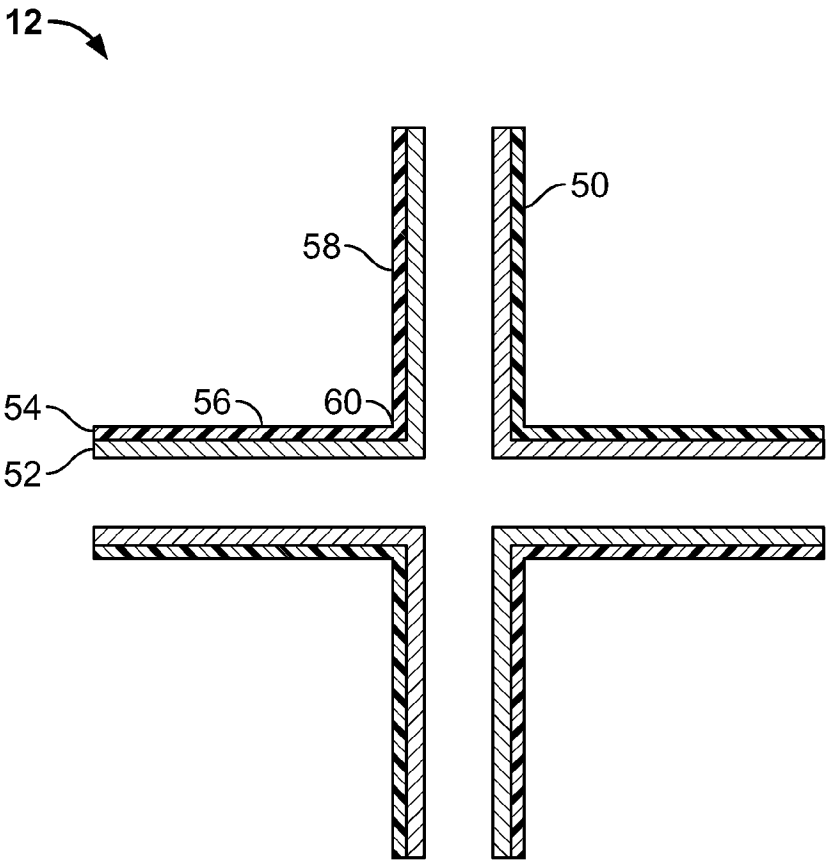
FIG. 2 is an exploded view of the exemplary separator shown in FIG. 1.

FIG. 2 is an exploded view of the separator 12, which is formed from a plurality of shield segments 50. In the illustrated embodiment, the separator 12 includes four shield segments 50 that are substantially identically formed. Each shield segment 50 includes a metallic layer 52 and a laminate layer 54. The laminate layer 54 is applied to the metallic layer 52 during a manufacturing process. For example, the laminate layer 54 may be coupled to the metallic layer 52, such as by a bonding process. In an exemplary embodiment, each shield segment 50 may be a laminated metal tape. The shield segments 50 may be made with any dimensions or shapes, depending on the particular application. In an exemplary embodiment, the shield segments 50 are extremely thin as compared to the overall diameter of the cable 10.

In the illustrated embodiment, the shield segments 50 are formed into an L-shape having a base 56 and a leg 58 extending from the base 56. For example, the shield segment 50 may be folded at approximately a 90° angle generally centered along the length of the shield segment to define the base 56 and the leg 58. The base 56 and the leg 58 generally intersect at a corner 60. Optionally, the base 56 and the leg 58 may have similar widths. The base 56 generally extends along the primary lateral axis 30 (shown in FIG. 1) and the leg 58 generally extends along the secondary lateral axis 32 (shown in FIG. 1). The shield segments 50 are oriented such that the metallic layer 52 is radially inward and the laminate layer 54 is radially outward with respect to one another. The laminate layer 54 defines an outer-most surface of the separator 12 and defines an exposed surface of the wall 38 (shown in FIG. 1).

Figure 3:
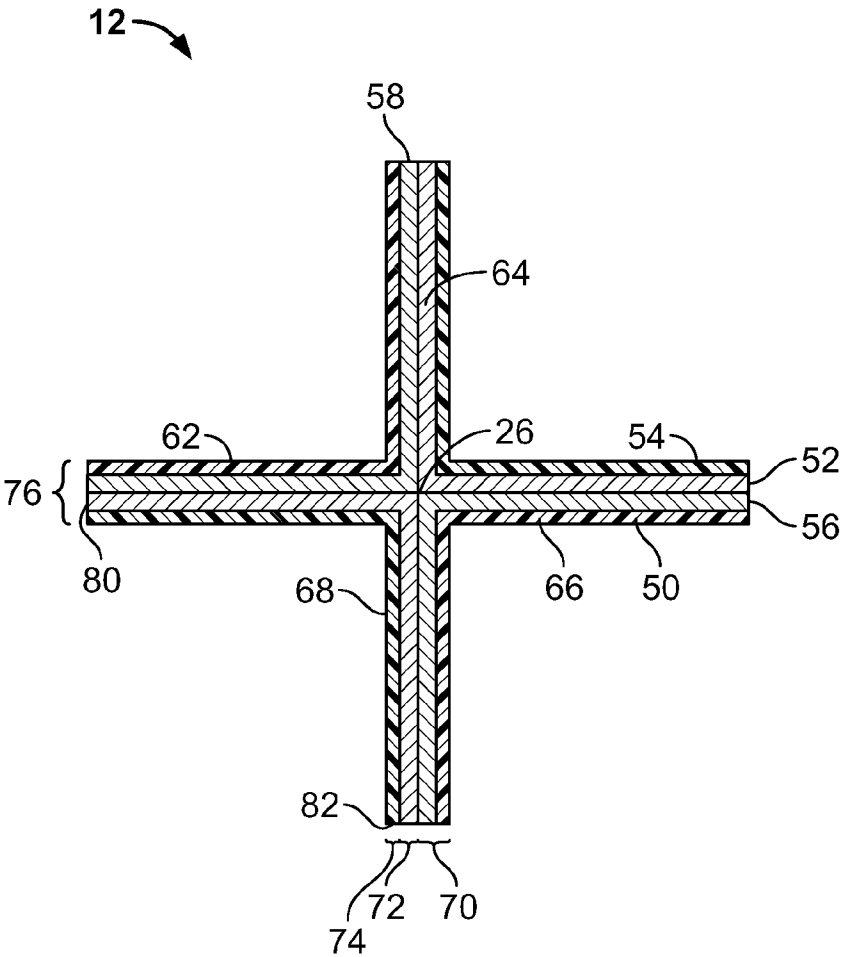
FIG. 3 is an assembled view of the separator shown in FIG. 2.

FIG. 3 is an assembled view of the separator 12 illustrating the plurality of shield segments 50 arranged adjacent to one another to form the separator 12. The shield segments 50 are similarly formed and positioned adjacent to one another. In the illustrated embodiment, the separator 12 includes a first shield segment 62, a second shield segment 64, a third shield segment 66 and a fourth shield segment 68. The shield segments 50 are arranged such that each base 56 abuts a base 56 of an adjacent shield segment 50 and such that each leg 58 abuts a leg 58 of an adjacent shield segment 50. The metallic layers 52 face one another and the laminate layers 54 face away from one another. Optionally, the metallic layers 52 may be coupled to one another, such as by applying an adhesive. Other bonding processes may be utilized in alternative embodiments, such as chemical or thermal bonding. The shield segments 50 are arranged such that each of the corners 60 generally meet and define the hub 34.

In an alternative embodiment, rather than each of the shield segments 62-68 being separate and distinct from one another, at least some of the shield segments are integrally formed with one another. For example, the first and second shield segments 62, 64 may be integrally formed and the third and the fourth shield segments 66, 68 may be integrally formed. The legs 58 are folded over on themselves such that the metallic layer engages itself along the leg 58. The bases 56 are connected to the bases 56 of the other element. Alternatively, all of the shield segments 62-68 may be integrally formed with one another.

In an exemplary embodiment, each shield segment 50 has a thickness 70. The thickness 70 may be equal to a thickness 72 of the metallic layer 52 and a thickness 74 of the laminate layer 54. Alternatively, other layers may be provided that may add to the thickness 70 of the shield segment 50. In an exemplary embodiment, the thickness 72 of the metallic layer 52 may be thicker than the thickness 74 of the laminate layer 54.

By using such a relatively thin laminate layer 74 as the only layer of non-conductive material between the separator 12 and the wire pairs, the overall thickness of the separator 12 may be comparatively thin when compared to separators fabricated from a dielectric material or shielded separators that have metal inserts placed inside of plastic casings. In alternative embodiments, the thickness 72 of the metallic layer 52 may be thinner than, or substantially equal to, the thickness 74 of the laminate layer 54. When assembled, the separator 12 has an overall thickness 76 that is equal to twice the thickness 70 of each shield segment 50 as the shield segments 50 are arranged back-to-back.

The shield segments 50 are connected to one another such that the bases 56 of adjacent shield segments 50 are continuously connected to one another along substantially the entire widths thereof and such that the legs 58 of adjacent shield segments 50 are continuously connected to one another along substantially the entire widths thereof. The shield segments 50 extend radially inward from proximate to the inner surface of the jacket 16 to the cable axis 26 such that each metallic layer 52 engages another metallic layer 52 at the cable axis 26. The metallic layers 52 engage one another for substantially the entire span from the inner surface of the jacket 16 to the cable axis 26. For example, the shield segments 50 may extend between first and second outer ends 80, 82, with the first end defining an end of the base.56 and the second end 82 defining an end of the leg 58. The first ends 80 are connected to one another such that the metallic layers 52 of the shield segments 50 engage one another from the first ends 80 to the cable axis 26. Similarly, the second ends 82 are connected to one another such that the metallic layers 52 of the shield segments 50 engage one another from the second ends 80 to the cable axis 26. The bases 56 and the legs 58 are connected to one another all the way to the corners 60. No intentional gaps are provided between the corners 60, as the corners 60 are intended to intersect one another. As such, the space between the base 56 and the leg 58 that defines the chamber 40 is as large as possible. Additionally, because the bases 56 and legs 58 are joined all the way into the corners 60, the shield segments 50 have double thickness along the entire widths of the walls 38 of the separator 12, making the walls 38 stronger and less susceptible to ripping during manufacturing of the cable 10 and/or during handling of the cable 10.

Figure 4:
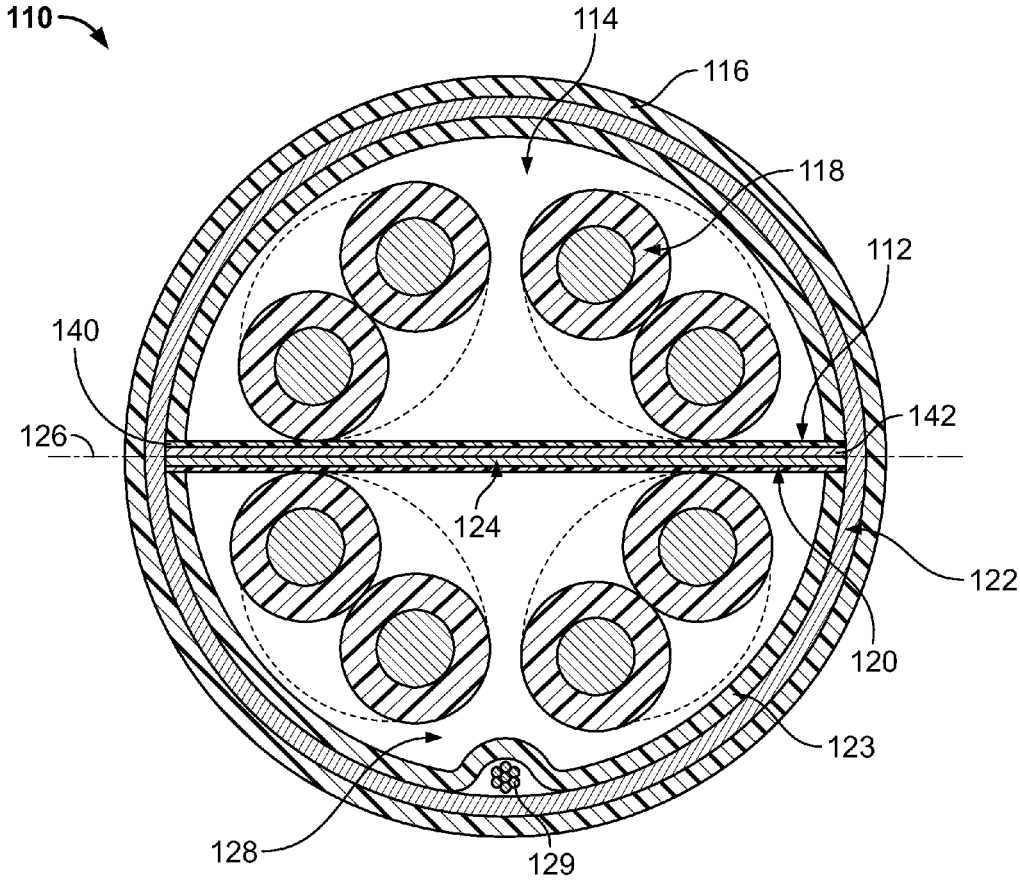
FIG. 4 is a cross-sectional view of cabling having a shielding separator in accordance with an alternative embodiment.

FIG. 4 is a cross-sectional view of cabling 110 and a shielding separator 112 in accordance with an alternative embodiment. The cable 110 includes a core 114 and a jacket 116 surrounding the core 114. The separator 112 is positioned within the core 114. A plurality of insulated wires 118 are also provided within the core 114. The wires 118 may be substantially similar to the wires 18 illustrated in FIG. 1. The separator 112 separates at least some of the wire pairs from one another and provides inter-cable shielding between the separated pairs. For example, the separator 112 includes at least one metallic layer 120 that provides shielding between the wire pairs.

In an exemplary embodiment, the separator 112 extends between first and second outer ends 140, 142. The first ends 140 are connected to one another and the second ends 142 are connected to one another such that the metallic layers 120 engage one another from the first ends 140 to a cable axis 124 and from the second ends 142 of the cable axis 124. The separator 112 extends between generally diametrically opposed sides of the jacket 116. The separator 112 may have a width that is substantially equal to an inner diameter of the jacket 116 such that the separator 112 engages the sides of the jacket 116. In an exemplary embodiment, the separator 112 generally maintains its shape when assembled and pulled into the core 114. For example, in the illustrated embodiment, the separator 112 has a generally planar flat shape. The separator 112 maintains the flat shape along the length of the cable 110. Optionally, during the cabling operation, the pairs may be twisted around one another such that the pairs are helically arranged along the cable axis 124. The separator 112 is likewise helically wound through the cable 110, but generally maintains the flat shape at any cross-section of the cable 110. The separator 112 may extend from the cable axis 124 in diametrically opposed directions without other portions extending outward therefrom in other directions.

The separator 112 is simpler to manufacture than the separator 12 (shown in FIG. 1) because the separator 112 does not need to be folded during the manufacturing process. As a result, the cable 110 may be manufactured cheaper than the cable 10 (shown in FIG. 1). Additionally, less material is required for the separator 112 than the separator 12, which further reduces the cost to manufacture the cable 110. Furthermore, less material is arranged within the core 114 because the separator 112 is approximately half the volume of the separator 12. As a result, the cable 110 may be smaller than the cable 10. Additionally, because the separator 112 includes only half the number of legs as compared to the separator 12, the manufactured cable 110 is less stiff, and thus more flexible than the cable 10. The more flexible cable 110 is easier to work with when running and terminating the cabling 110.

The cable 110 includes a cable shield 122 that is provided along the inner surface of the jacket 116. The cable shield 122 provides circumferential shielding around the core 114. In an exemplary embodiment, the metallic layer 120 of the separator 112 is configured to be electrically coupled to the cable shield 122 to common the cable shield 122 and the separator 112. The cable 110 also includes a binder layer or inner layer 123 that is positioned radially inward with respect to the cable shield 122. The binder layer 123 is fabricated from a non-conductive material, such as a plastic material. Alternatively, the cable shield 122 may define the inner-most layer of the cable 110. The cable 110 and separator 112 extend along the cable axis 124. The separator 112 is also arranged along or defines a primary lateral axis 126 that generally bi-sects the core 114 of the cable 110. In an exemplary embodiment, the core 114 includes two chambers 128 defined by the separator 112 and the cable 110. The chambers are generally hemispherical in shape. In the illustrated embodiment, the cable 110 includes a drain wire(s) 129. The drain wire 129 is positioned between the cable shield 122 and the binder layer 123. The cable shield 122 is electrically connected to the drain wire 129. Optionally, the drain wire 129 may be electrically connected to the metallic layer 120 of the separator 112. For example, the drain wire 129 may be positioned between at least some of the metallic layers 120. The cable 110 may be manufactured without the drain wire 129 and/or without the cable shield 122.

Figure 5:
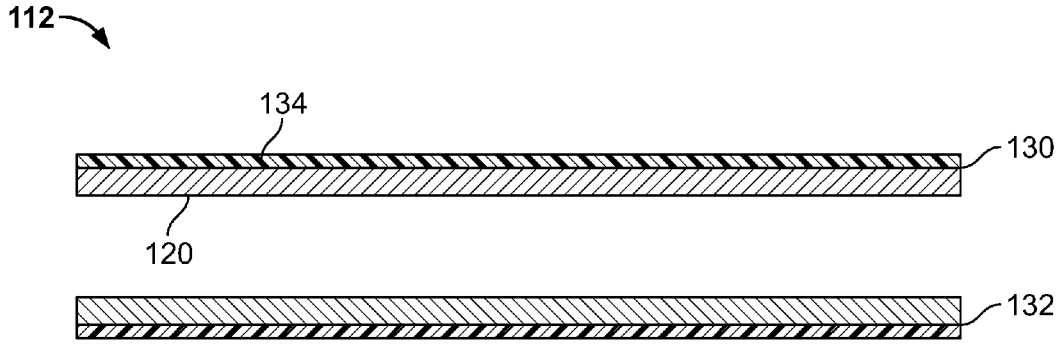
FIG. 5 is an exploded view of the separator shown in FIG. 4.

FIG. 5 is an exploded view of the separator 112. The separator 112 is formed in a similar manner as the separator 12 (shown in FIG. 1). The separator 112 includes first and second shield segments 130, 132. Each shield segment 130, 132 includes a metallic layer 120 and a laminate layer 134. The shield segments 130, 132 are joined to one another prior to, or as, the separator 112 is loaded into the core 114 (shown in FIG. 4). The shield segments 130. 132 are arranged such that the metallic layers 120 face one another and the laminate layers 134 face away from one another. Once assembled, the shield segments 130, 132 of the separator 112 remain generally flat when loaded into the core 114. The first and second shield segments 130, 132 have a general equal widths 136.

The metallic layers 120 are continuously joined to one another for substantially the entire widths 136 of the shield segments 130, 132. Optionally, a drain wire (not shown) may be positioned between the shield segments 130, 132.

In an alternative embodiment, rather than having first and second shield segments 130, 132, the separator 112 may include a single shield segment having a metallic layer 120 and laminate layers 134 on both sides of the metallic layer 120. The laminate layers 134 define exposed surfaces when the separator 112 is loaded into the core 114 and the wire pairs may engage or abut the laminate layers 134 within the core 114. The laminate layers 134 are thus positioned between the metallic layer 120 and the wires 118 (shown in FIG. 4) of the wire pairs to electrically isolate the metallic layer 120 from the wires 118. As such, if the conductor of one of the wires were to be exposed, the conductor would not engage the metallic layer 120.

Figure 6:
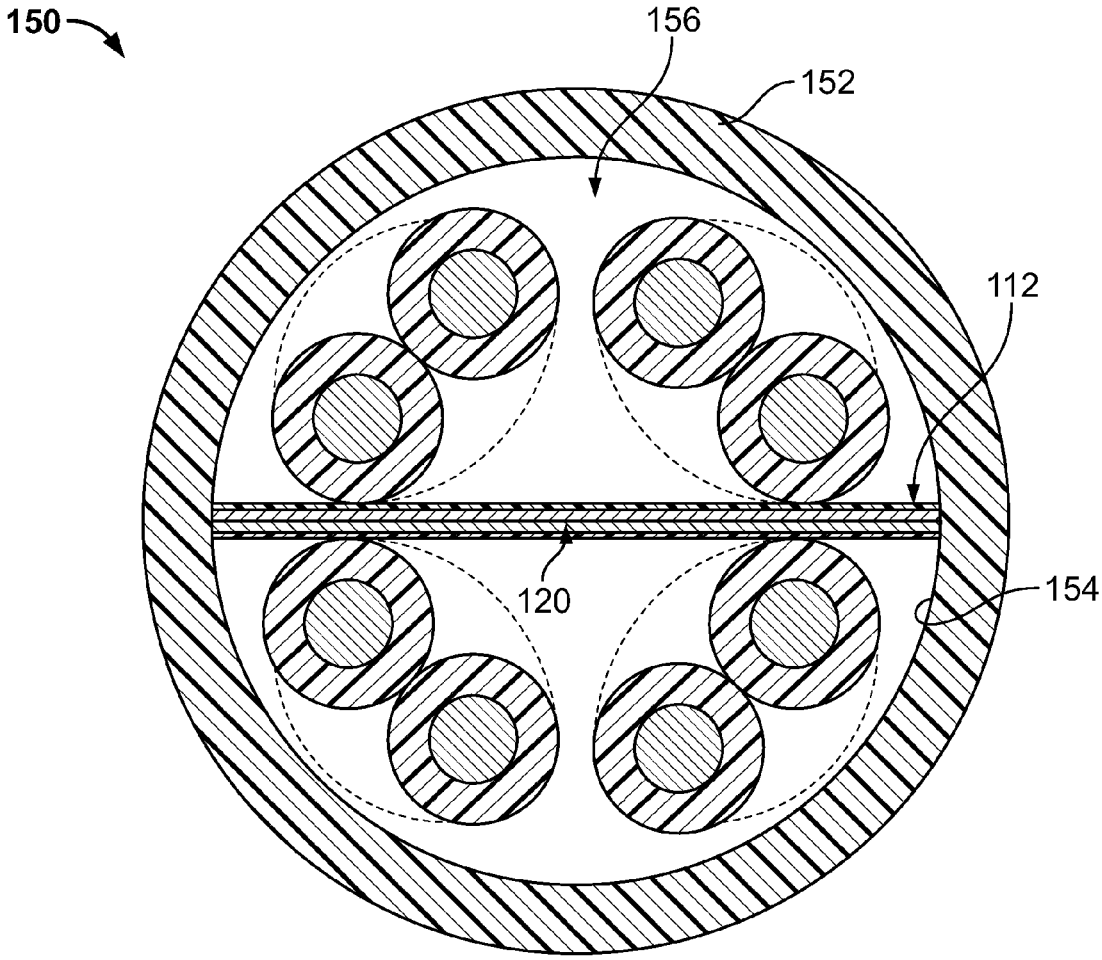
FIG. 6 is a cross-sectional view of the separator shown in FIG. 5 used in alternative cabling.

FIG. 6 is a cross-sectional view of the separator 112 used with cabling 150, where the separator 112 is not connected to a cable shield. The cabling 150 includes a jacket 152 having an inner surface 154 that defines a core 156. The separator 112 is received in the core 156 and generally engages the inner surface 154 at two different points. The jacket 152 may be similar to the jacket 16, and not include a cable shield. Alternatively, the jacket 152 may be similar to the jacket 116 and include a cable shield. However, in contrast to the embodiment shown in FIG. 4, the metallic layers 120 of the separator 112 do not electrically engage any cable shield. The separator 112 merely provides inter-cable shielding between pairs of wires held within the two chambers defined by the separator 112.

Figure 7:
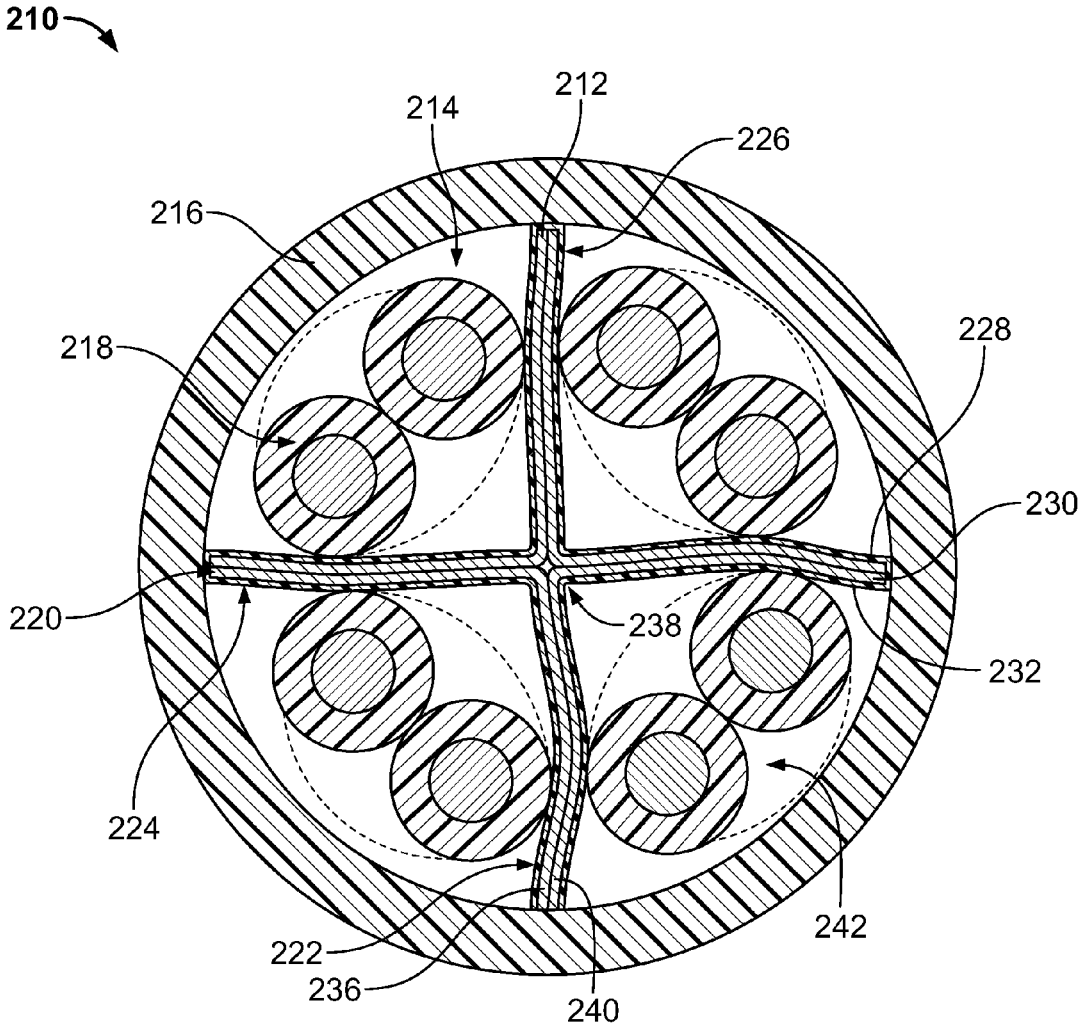
FIG. 7 is a cross-sectional view of cabling having a shielding separator in accordance with yet another alternative embodiment.

FIG. 7 is a cross-sectional view of cabling 210 having an alternative shielding separator 212. The cable 210 includes a core 214 and a jacket 216 surrounding the core 214. The separator 212 is positioned within the core 214. A plurality of insulated wires 218 are also provided within the core 214. The wires 218 may be substantially similar to the wires 18 illustrated in FIG. 1. The separator 212 separates the wire pairs from one another and provides shielding between the separated wire pairs.

The separator 212 includes a single shield segment 220 that is formed into a plus sign shape. In an exemplary embodiment, the shield segment 220 is a laminated metal tape. The shield segment 220 includes a first leg 222, a second leg 224, a third leg 226 and a fourth leg 228. The shield segment 220 includes a metallic layer 230 and a laminate layer 232. The metallic layer 230 defines an inner layer and the laminate layer 232 defines an outer layer of the separator 212. As such, the laminate layer 232 defines an exposed surface of the separator 212 within the core 214 when the separator 212 is loaded into the core 214. The wire pairs may engage or abut the laminate layers 232 within the core 214, which electrically isolates the metallic layer 220 from the wires 218.

In an exemplary embodiment, each leg 222-228 includes two sections of the shield segment 220. For example, the shield segment 220 may include a first end 236 arranged at a distal end of the first leg 222. The shield segment 220 extends along the first leg 222 to a hub 238 of the separator 212. The shield segment 220 extends along one side of the second leg 224 to the distal end of the second leg 224 and is folded over approximately 180 degrees and extends back along the other side of the second leg 224 toward the hub 238. The shield segment 220 then extends in a similar fashion along the third leg 226 and the fourth leg 228. The shield segment 220 then extends back along the first leg 222 such that a second end 240 of the shield segment 220 is positioned adjacent to the first end 236 at the distal end of the first leg 222. As such, a continuous shield segment 220 may define each of the legs 222-228 of the separator 212. In an alternative embodiment, the shield segment 220 may define less than all of the legs.

In an exemplary embodiment, the shield segment 220 is resilient and/or flexible. For example, the laminate layer 232 and/or the metallic layer 230 may have characteristics that allow the position of the shield segment 220 within the core 214 to be changed relative to the jacket 216 along the length of the separator 212. For example, as the wire pairs are twisted around one another, the relative positions of the wires 218 change with respect to one another. Chambers 242 defined by the separator 212 may be sized as small as possible, while still accommodating the wires 218. By allowing the separator 212 to move generally towards or away from the chambers 242, the wires 118 are capable of moving within the chambers 242, such as to accommodate twisting.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed is:

1. Cabling comprising:

a jacket having an inner surface defining a core, the core extending along a cable axis; and a separator positioned in the core, the separator having at least one shield segment defining at least portions of walls separating the core into a plurality of chambers each configured to receive at least one twisted wire pair, each shield segment including a metallic layer and a laminate layer, the laminate layer defining an exposed surface of the wall of the corresponding chamber, the shield segments extending from proximate to the inner surface of the jacket to the cable axis such that each metallic layer engages another metallic layer at the cable axis.

2. The cabling of claim 1, wherein the shield segment engages the inner surface of the jacket and extends radially inward to the cable axis, the metallic layers engaging one another for the entire span from the inner surface of the jacket to the cable axis.

3. The cabling of claim 1, wherein the shield segment is folded over such that different sections of the metallic layer engage one another.

4. The cabling of claim 1, wherein the at least one shield segment defines a first shield segment and a second shield segment, the first and second shield segments extend between first and second ends, the first ends being connected to one another such that the metallic layers of the first and second segments engage one another from the first ends to the cable axis.

5. The cabling of claim 1, wherein the at least one shield segment defines a first shield segment and a second shield segment, the first and second shield segments extend between first and second ends, the metallic layers of the first and second shield segments engage one another from the first ends to the cable axis and from the second ends to the cable axis.

6. The cabling of claim 1, wherein the at least one shield segment defines a first shield segment and a second shield segment, the first and second shield segments have substantially equal widths extending between first and second ends, the metallic layers of the first and second shield segments engaging one another for substantially the entire widths thereof.

7. The separator of claim 1, wherein the at least one shield segment defines first and second shield segments being L-shaped with a base and a leg meeting at a corner, the first and second shield segments are oriented so that the bases abut one another, the corners of the first and second shield segments are both positioned at the cable axis such that the legs extend in opposite directions from one another.

8. The separator of claim 1, wherein the at least one shield segment defines first, second, third and fourth shield segments, each shield segment having perpendicular legs intersecting at a corner, the corners of each shield segment meeting at the cable axis and the legs extending radially outward toward the jacket.

9. The separator of claim 1, wherein the separator has a cruciform shape with generally radially extending legs meeting at the cable axis, the separator maintaining the cruciform shape when assembled with the wires.

10. A separator for separating wire pairs within cabling, the separator comprising:

a first shield segment including a first metallic layer and a first laminate layer, the first shield segment having a first width; and a second shield segment including a second metallic layer and a second laminate layer, the second shield segment having a second width being substantially equal to the first width;

wherein the first and second shield segments are arranged such that the first metallic layer continuously engages the second metallic layer for substantially the entire first and second widths, the first laminate layer defines a first chamber within the cabling configured to receive a first of the wire pairs and the second laminate layer defines a second chamber within the cabling configured to receive a second of the wire pairs, the first and second laminate layers exposed within the respective first and second chambers.

11. The separator of claim 10, wherein the first and second shield segments are generally planar and cooperate to divide the cabling into two hemispheres.

12. Cabling comprising:

a jacket surrounding a core; and a separator positioned in the core, the separator having at least one shield segment defining at least portions of walls separating the core into a plurality of chambers each configured to receive a plurality of twisted wire pairs, each shield segment including a metallic layer and a laminate layer, the laminate layer defining an exposed surface of the wall of the corresponding chamber.

13. The cabling of claim 12, wherein each shield segment comprises a laminated metal tape.

14. The cabling of claim 12, wherein the metallic layer provides shielding between adjacent chambers.

15. The cabling of claim 12, wherein the separator is generally planar and has a width approximately equal to a diameter of the core.

16. The cabling of claim 12, wherein the separator engages an inner surface of the jacket at opposed sides of the jacket.

17. The cabling of claim 12, wherein the core extends along a cable axis, the separator extending from the cable axis in diametrically opposed directions.

18. The cabling of claim 12, wherein the separator divides the core into hemispherically shaped chambers.

19. The cabling of claim 12, wherein the separator includes a first shield segment and a second shield segment, the metallic layers of the first and second shield segments continuously engaging one another along substantially an entire width of each shield segment.

20. The cabling of claim 12, wherein the metallic layer is thicker than the laminate layer.

* * * * *